US011363368B1

(12) United States Patent
Lee

(10) Patent No.: US 11,363,368 B1
(45) Date of Patent: Jun. 14, 2022

(54) EAR TIP INCLUDING PARTITION WALL STRUCTURE WITH IMPROVED ACTIVE NOISE CANCELING FUNCTION

(71) Applicant: AZLA Inc., Seoul (KR)

(72) Inventor: Sang Won Lee, Seoul (KR)

(73) Assignee: Azla Inc., Seoul (KR)

( * ) Notice: Subject to any disclaimer, the term of this patent is extended or adjusted under 35 U.S.C. 154(b) by 0 days.

(21) Appl. No.: 17/668,790

(22) Filed: Feb. 10, 2022

(30) Foreign Application Priority Data

Feb. 16, 2021 (KR) ..... 10-2021-0020589

(51) Int. Cl.
*H04R 1/10* (2006.01)

(52) U.S. Cl.
CPC ..... *H04R 1/1083* (2013.01); *H04R 1/1016* (2013.01); *H04R 1/1025* (2013.01); *H04R 1/1041* (2013.01); *H04R 2460/01* (2013.01)

(58) Field of Classification Search
None
See application file for complete search history.

(56) References Cited

U.S. PATENT DOCUMENTS

| | | | | |
|---|---|---|---|---|
| 2019/0208302 | A1* | 7/2019 | Monti | H04R 25/656 |
| 2021/0258678 | A1* | 8/2021 | Huwe | H04R 1/1016 |
| 2022/0095033 | A1* | 3/2022 | Shinmen | H04R 1/1016 |

FOREIGN PATENT DOCUMENTS

| | | | |
|---|---|---|---|
| JP | 2015-061206 | A | 3/2015 |
| KR | 10-1341867 | B1 | 12/2013 |
| KR | 10-1960789 | B1 | 3/2019 |

* cited by examiner

*Primary Examiner* — Paul W Huber
(74) *Attorney, Agent, or Firm* — Fay Sharpe LLP

(57) ABSTRACT

Disclosed is an ear tip including a partition wall structure with an improved active noise canceling function. The ear tip according to the embodiment of the present disclosure is mounted at one side of an earphone, inserted into an external auditory meatus of a wearer, and configured to stably fix a position of the earphone, the ear tip including: a main body part having a hollow cylinder structure corresponding to an outer peripheral surface of the earphone; an external auditory meatus contact part radially protruding from an outer peripheral surface of a lower end of the main body part, extending upward by a predetermined height, and configured to come into contact with an inner surface of the external auditory meatus of the wearer; a partition wall structure mounted and structured to divide a space defined by the outer peripheral surface of the main body part and an inner peripheral surface of the external auditory meatus contact part; and an elastic filling member having a predetermined magnitude of elastic restoring force and accommodated in any space selected from the spaces divided by the partition wall structure. According to the present disclosure, it is possible to provide the ear tip including a partition wall structure that improves an active noise canceling function and an external noise blocking force as the ear tip comes into contact with the skin surface of the external auditory meatus of the wearer when the wearer wears the ear tip in the ear.

3 Claims, 9 Drawing Sheets

[FIG. 1]
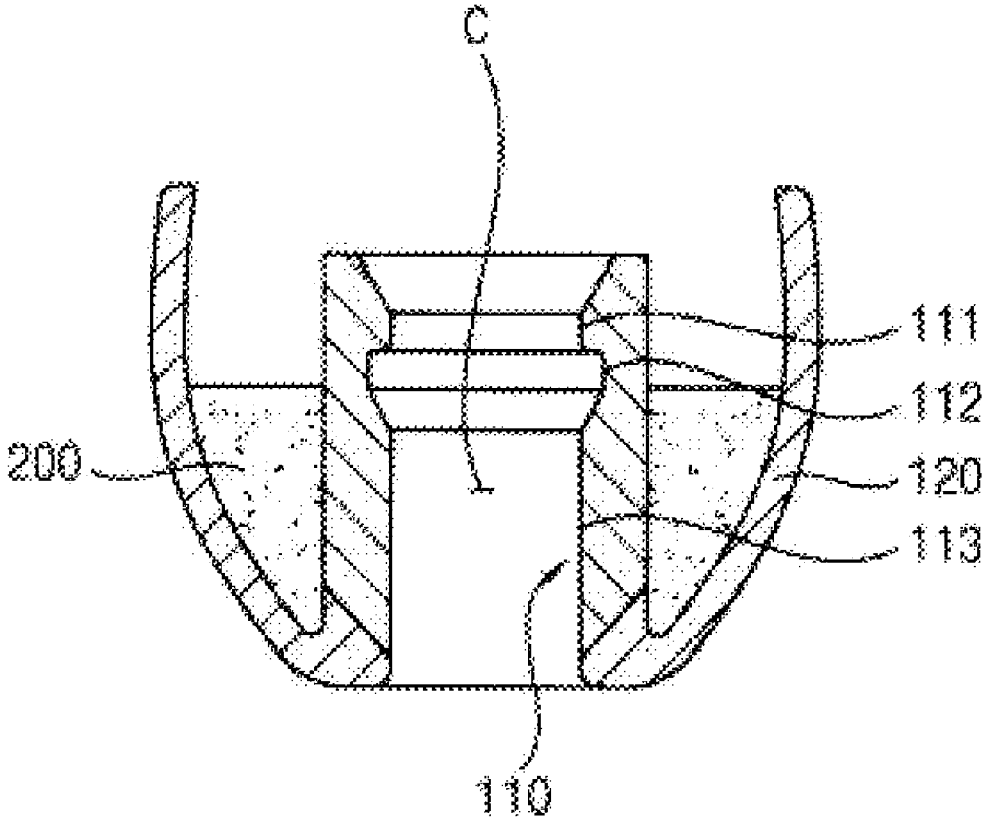

[FIG. 2]
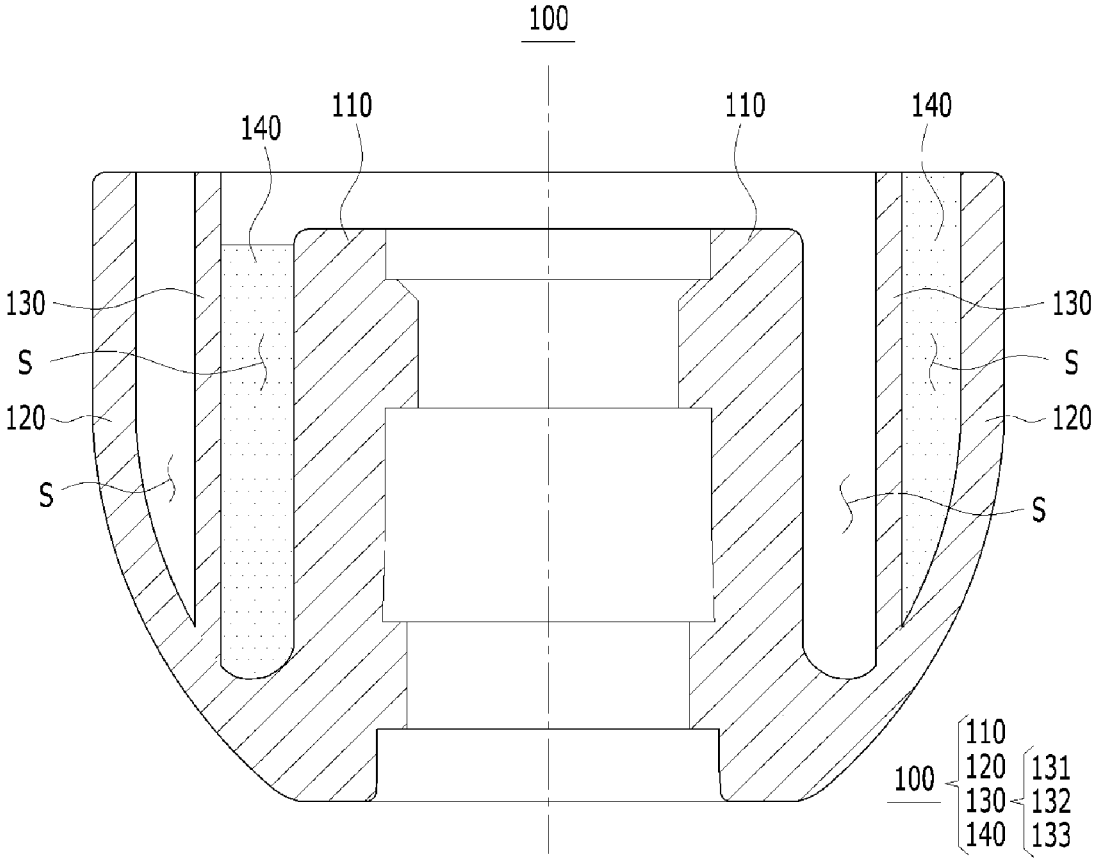

[FIG. 3]
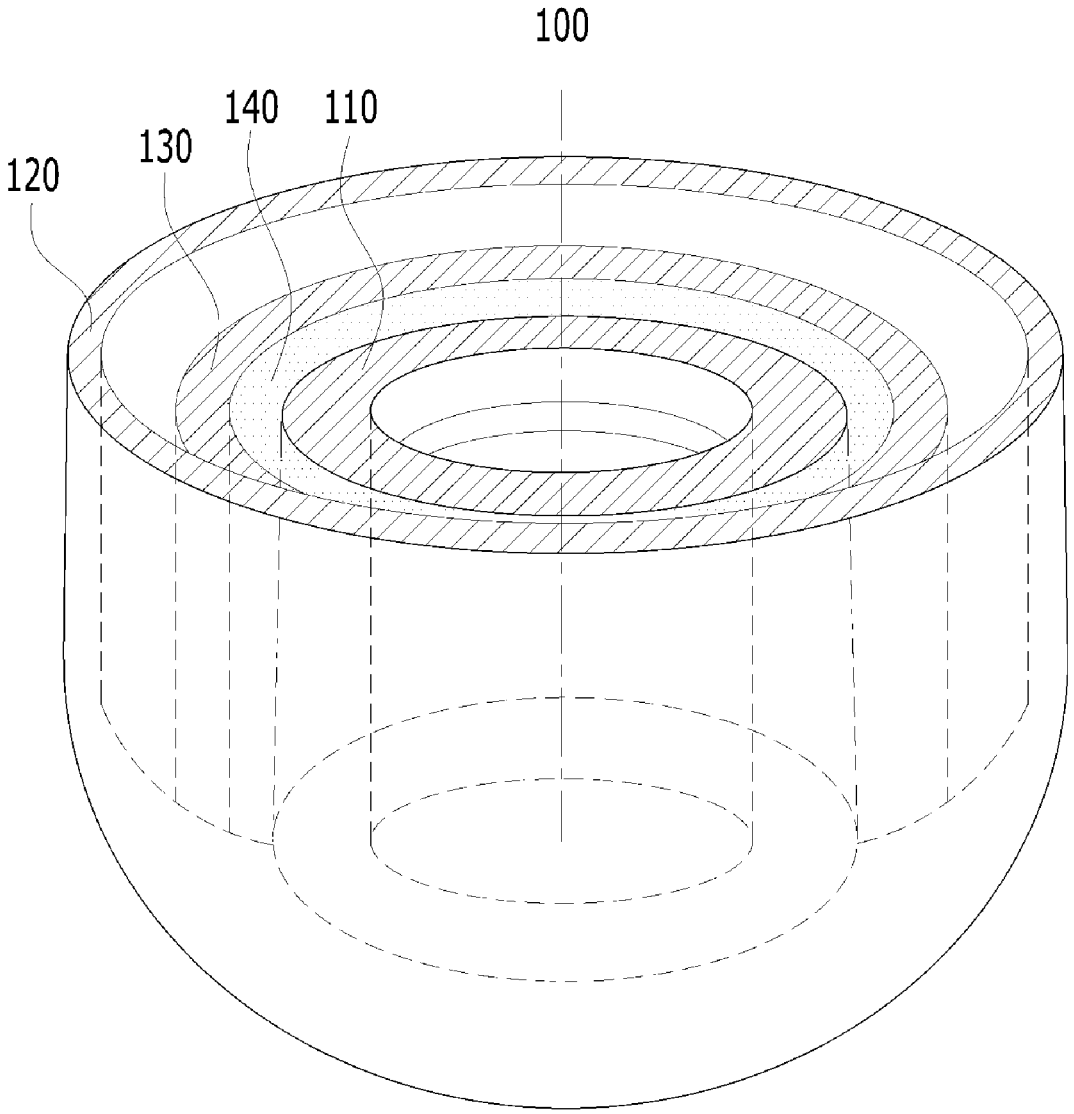

[FIG. 4]
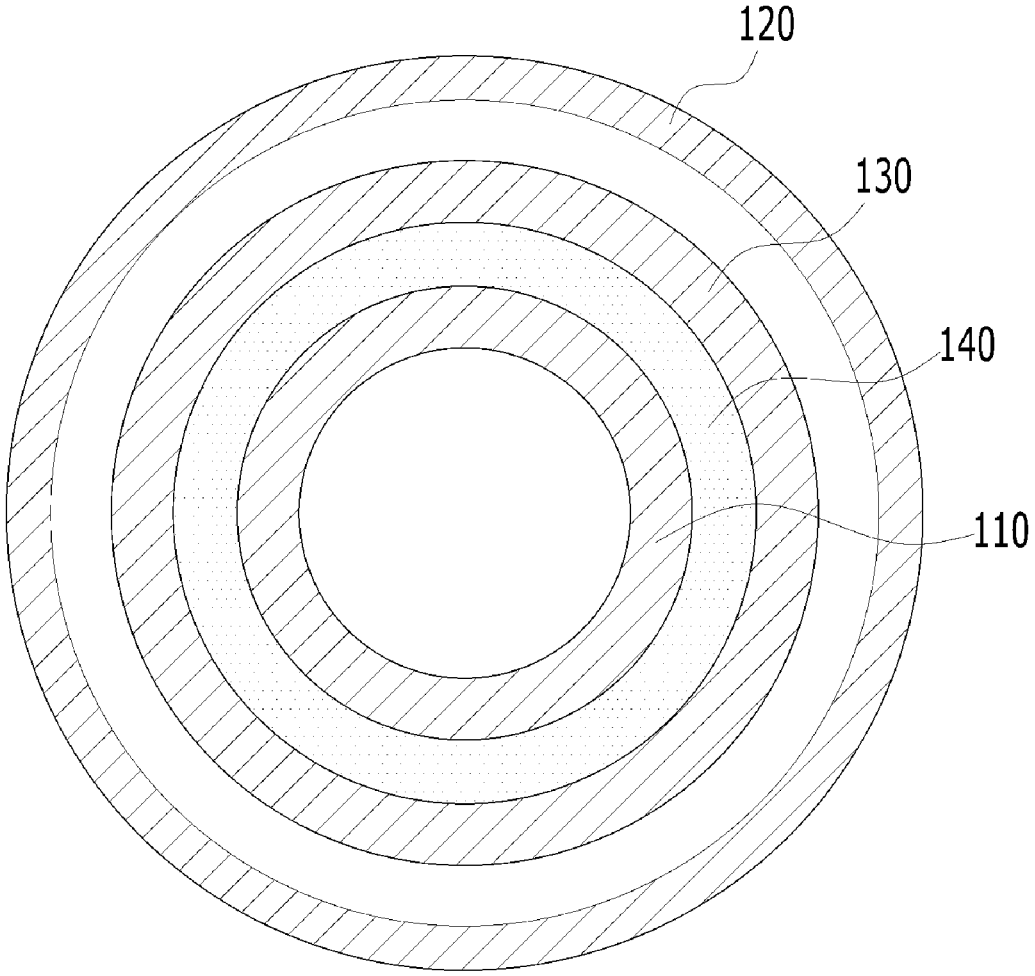

[FIG. 5]
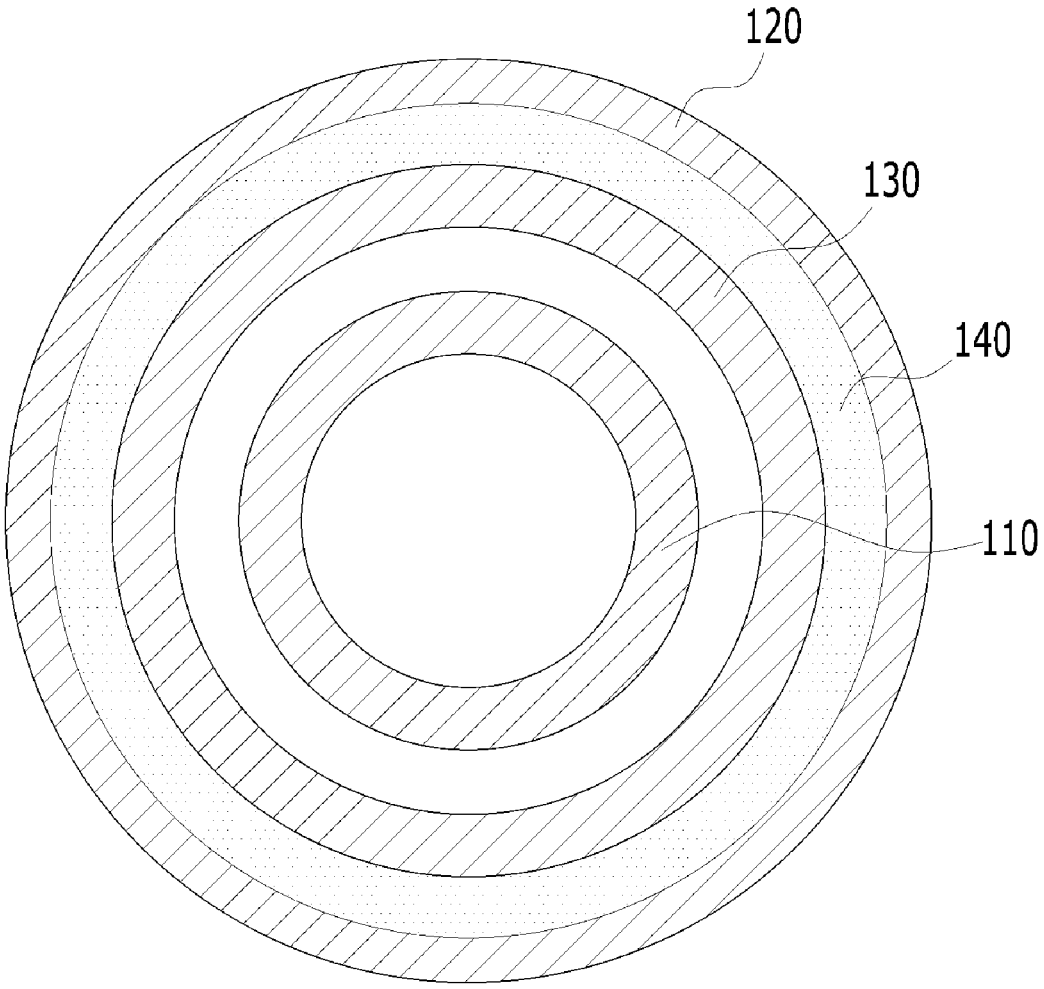

[FIG. 6]
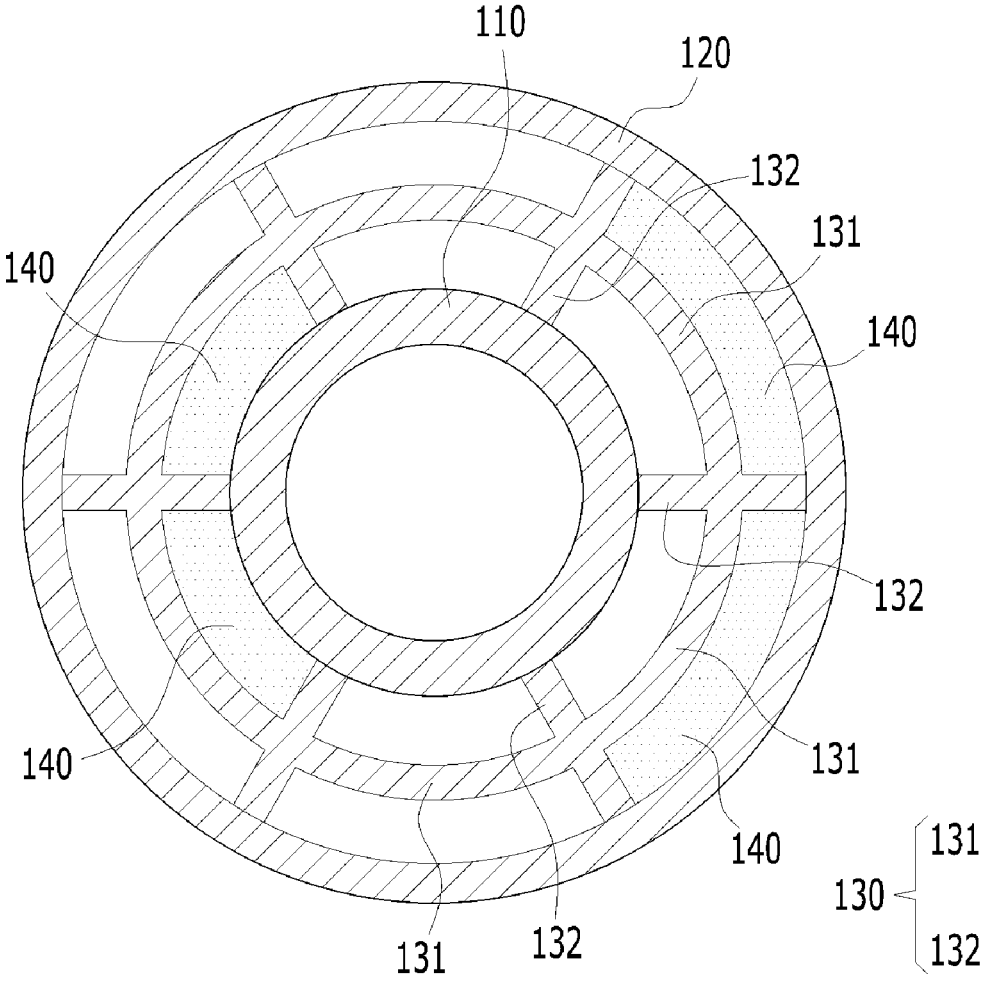

[FIG. 7]
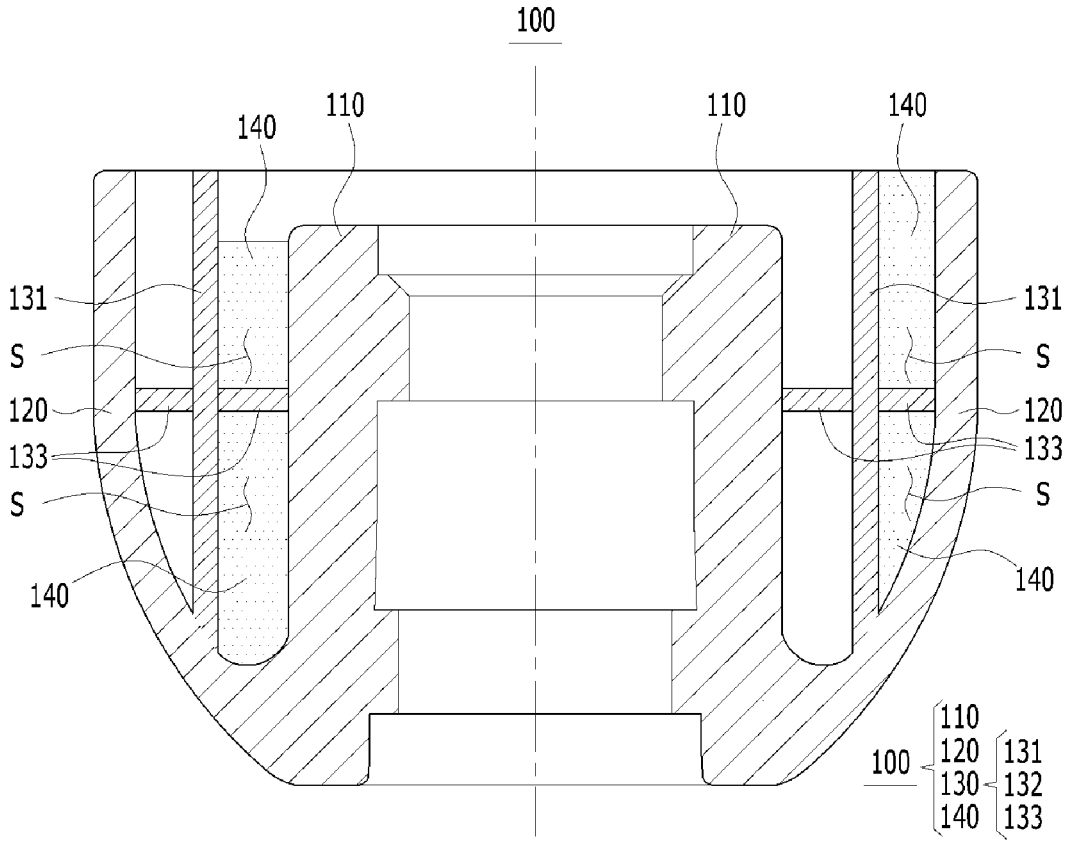

[FIG. 8]
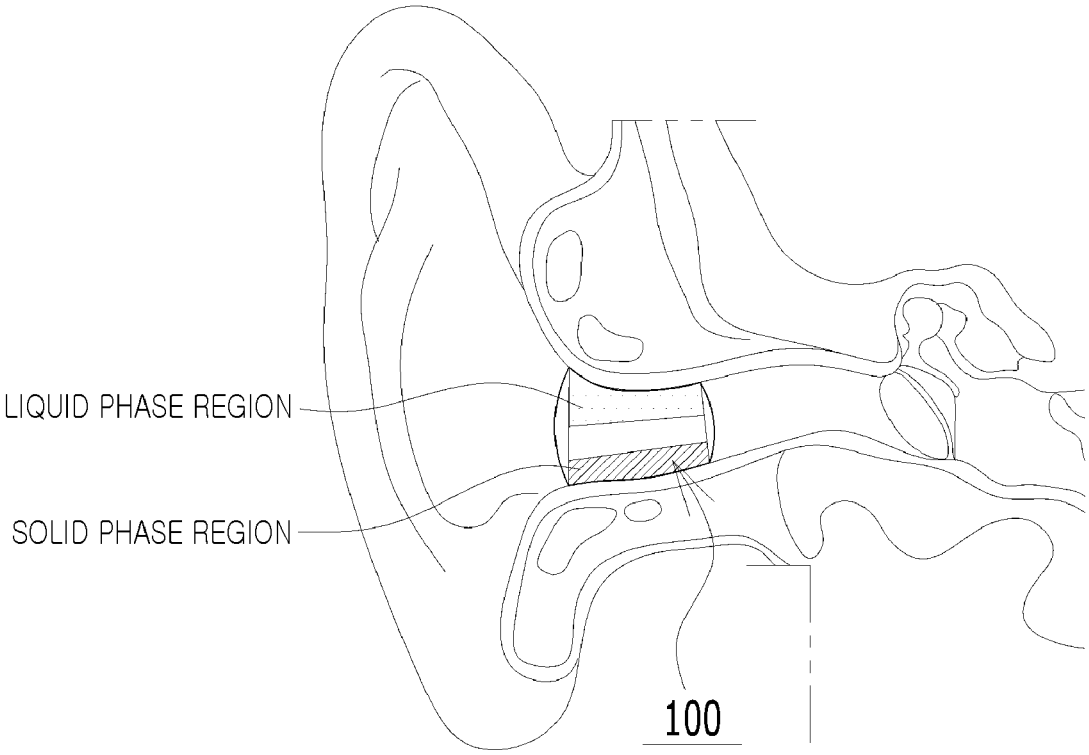

[FIG. 9]
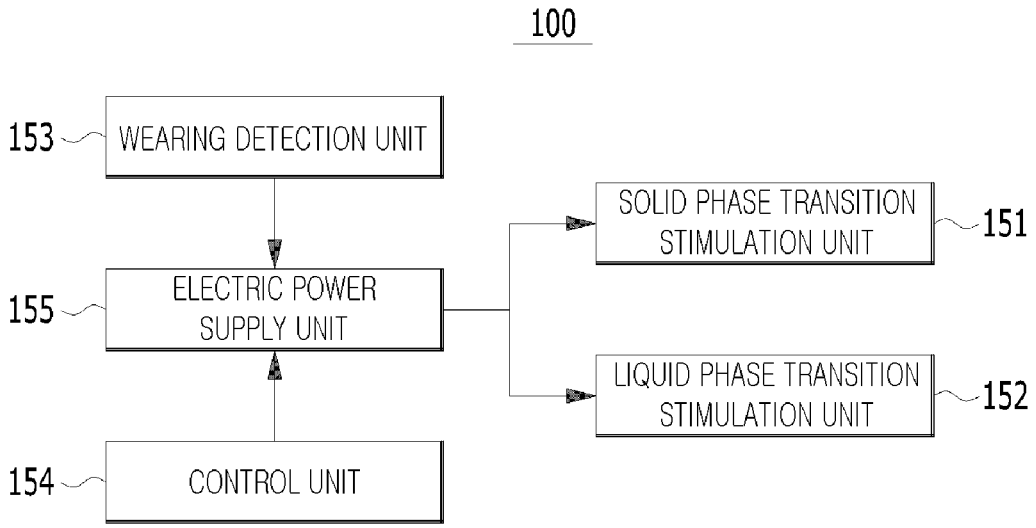

EAR TIP INCLUDING PARTITION WALL STRUCTURE WITH IMPROVED ACTIVE NOISE CANCELING FUNCTION

BACKGROUND

Field

The present disclosure relates to an ear tip, and more particularly, to an ear tip including a partition wall structure that improves an active noise canceling function and an external noise blocking force.

Description of the Related Art

Recently, many smartphone users use typical earphones or Bluetooth earphones with hands-free functions when the users listen to music or make phone calls with smartphones.

In most cases, the smartphone comes with earphones when the user purchases the smartphone for the first time. In comparison with headphones, the earphones provide a slightly small sound volume. However, because the earphone has a small size and thus is easy to carry, the earphone has become a necessity for life along with the popular spread of smartphones.

The earphones may be broadly classified in terms of shapes into an open-type earphone and a canal-type earphone. The open-type earphones were widely used in the case of initial models, but recently, the open-type earphones and the canal-type earphones are used at a similar ratio.

The advantage of the open-type earphone is that a speaker module disposed in a housing of the earphone is not completely sealed by an earhole, the sound is not transmitted directly to the ear, and the sound partially leaks, which enables the user to feel comfortable open feeling. The canal-type earphone advantageously has an effect of blocking noise. When an ear tip matched with a width of an internal ear is mounted regardless of a shape of an external ear that varies from person to person, the ear tip comes into close contact with the ear hole well, which makes a high fixing force.

The open-type earphone and the canal-type earphone are in a complementary relationship. The canal-type earphone was created in an effort to solve the problem of a low ability of playing sound in a low sound range caused by the fixing force and sound leak and solve the problem of an inflow of external noise, which are the drawbacks of the open-type earphone. In contrast to the open-type earphone, the canal-type earphone has the fixing force and the function of blocking noise and is strong for the sound range of the low-pitched sound because the canal-type earphone is in close contact with the earhole and the air does not circulate well. However, the canal-type earphone disadvantageously causes the person to feel irritation, stuffiness, and pain.

In addition, like a hermetic headphone, the canal-type earphone minimizes external noise by bringing a speaker and the ear into maximally close contact with each other, such that sound disturbance caused by surrounding sound is low, and the sound generated by a vibration diaphragm does not leak to the outside. Therefore, the canal-type earphone is advantageous because the user may listen to music and does not damage the surrounding in a location where an external environment is poor, i.e., external noise is severe. However, in comparison with the open-type earphone, the wearing comfort of the canal-type earphone is not relatively good because of a pressure of the ear tip being in close contact with the ear when the canal-type earphone is used over a long period of time. Further, the canal-type earphone has a drawback in that because the sound of the vibration diaphragm directly affects a tympanum, the tympanum may receive impact caused by the air pressure.

To solve the problems, as illustrated in FIG. 1, a filling material 200 is inserted into an internal space of an ear tip and in close contact with an earhole. A pressure of the filling material may partially block external noise, but cause discomfort in wearing an earphone and make it difficult for the user to comfortably listen to music.

Therefore, there is a need for a technology capable of solving the above-mentioned problems in the related art.

DOCUMENT OF RELATED ART

Patent Document (Patent Document 0001) Korean Patent No. 10-1323805 (registered on Oct. 24, 2013)

SUMMARY

An object of the present disclosure is to provide an ear tip including a partition wall structure that improves an active noise canceling function and an external noise blocking force as the ear tip comes into close contact with a skin surface of an external auditory meatus of a wearer when the wearer wears the ear tip in the ear.

According to an aspect of the present disclosure, there is provided an ear tip, which is mounted at one side of an earphone, inserted into an external auditory meatus of a wearer, and configured to stably fix a position of the earphone, the ear tip including: a main body part having a hollow cylinder structure corresponding to an outer peripheral surface of the earphone; an external auditory meatus contact part radially protruding from an outer peripheral surface of a lower end of the main body part, extending upward by a predetermined height, and configured to come into contact with an inner surface of the external auditory meatus of the wearer; a partition wall structure mounted and structured to divide a space defined by the outer peripheral surface of the main body part and an inner peripheral surface of the external auditory meatus contact part; and an elastic filling member having a predetermined magnitude of elastic restoring force and accommodated in any space selected from the spaces divided by the partition wall structure.

In the embodiment of the present disclosure, the partition wall structure may be made of a flexible material naturally deformable by a pressure of a user's finger.

In the embodiment of the present disclosure, the partition wall structure may include a plurality of first partition walls mounted to be spaced apart from one another at a predetermined angle along the outer peripheral surface of the main body part and having a plate-shaped structure that connects the outer peripheral surface of the main body part and the inner peripheral surface of the external auditory meatus contact part on a single plane.

In the embodiment of the present disclosure, the partition wall structure may include a plurality of second partition walls having a plate-shaped structure connecting the plurality of first partition walls, having a curved structure spaced apart from the outer peripheral surface of the main body part at a predetermined distance, and mounted to define a hollow column structure together with the first partition walls.

In the embodiment of the present disclosure, the partition wall structure may include a third partition wall configured to divide, in a vertical direction, the space defined by the outer peripheral surface of the main body part and the inner peripheral surface of the external auditory meatus contact part.

In the embodiment of the present disclosure, the elastic filling member may be made of silicone gel or polyurethane gel.

In the embodiment of the present disclosure, the elastic filling member may include a phase change fluid that experiences phase transition between a gel state and a solid state by external electrical stimulation.

In this case, the phase change fluid may include supercooled substances and nuclear particles for changing the phase of the supercooled substances, and the nuclear particles may be graphite or conductive particles mixed with the supercooled substances to transmit the electrical stimulation to the phase change fluid.

In the embodiment of the present disclosure, the ear tip may include: a solid phase transition stimulation unit mounted on one surface of the main body part, including a plurality of electrodes introduced into the space defined by the partition wall structure, and configured to apply the electrical stimulation to the interior of the space defined by the partition wall structure by being supplied with electric power from the electric power supply unit; a liquid phase transition stimulation unit mounted on one side of the main body part, including a plurality of thermoelectric elements introduced into the space defined by the partition wall structure, and configured to heat to the interior of the space defined by the partition wall structure by being supplied with electric power from the electric power supply unit; a wearing detection unit mounted on the outer peripheral surface of the main body part and configured to detect a state in which the ear tip is in contact with the skin of the external auditory meatus of the wearer and transmit detected data to a control unit; an electric power supply unit mounted on one surface of the main body part and configured to provide electric power, which is stored in a secondary battery rechargeable in a wireless manner, to the solid phase transition stimulation unit and the liquid phase transition stimulation unit in accordance with a control signal of the control unit; and the control unit mounted on one surface of the main body part and configured to control operations of the solid phase transition stimulation unit and the liquid phase transition stimulation unit on the basis of the data detected by the wearing detection unit.

As described above, according to the ear tip according to the present disclosure, the main body part having a specific structure, the external auditory meatus contact part, the partition wall structure, and the elastic filling member are provided. Therefore, it is possible to provide the ear tip including a partition wall structure that improves an active noise canceling function and an external noise blocking force as the ear tip comes into contact with the skin surface of the external auditory meatus of the wearer when the wearer wears the ear tip in the ear.

In addition, according to the ear tip according to the present disclosure, the partition wall structure including the first partition wall, the second partition wall, and the third partition wall, which have the specific structures, is provided, and the space, which is optionally selected from the spaces defined by the partition wall structure, is filled with the elastic filling member. Therefore, it is possible to provide the ear tip including the partition wall structure that improves an active noise canceling function and an external noise blocking force as the ear tip comes into contact with the skin surface of the external auditory meatus of the wearer when the wearer wears the ear tip in the ear.

In addition, according to the ear tip of the present disclosure, the partition wall structure including the first partition wall, the second partition wall, and the third partition wall, which have the specific structures, is provided, and the space, which is optionally selected from the spaces defined by the partition wall structure, is filled with the phase change fluid, such that the flexibility of the sidewalls constituting the pressure dispersion part may be changed in some instances, and the wearing comfort of the ear tip may be adjusted in accordance with the user's preference. The user may bring the ear tip into close contact with the external auditory meatus and fix the ear tip by changing the flexibility of the pressure dispersion part after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

In addition, according to the ear tip according to the present embodiment, the solid phase transition stimulation unit, the liquid phase transition stimulation unit, the wearing detection unit, the electric power supply unit, and the control unit, which perform the specific functions, are provided, and the flexibility of the space defined by the partition wall structure may be changed depending on whether the ear tip is worn, such that the wearing comfort of the ear tip may be adjusted in accordance with the user's preference. The user may bring the ear tip into close contact with the external auditory meatus and fix the ear tip by changing the flexibility of the space defined by the partition wall structure after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

BRIEF DESCRIPTION OF THE DRAWINGS

The above and other aspects, features and other advantages of the present disclosure will be more clearly understood from the following detailed description taken in conjunction with the accompanying drawings, in which:

FIG. 1 is a cross-sectional view illustrating an ear tip in the related art;

FIG. 2 is a vertical cross-sectional view illustrating an ear tip according to an embodiment of the present disclosure;

FIG. 3 is a perspective view illustrating the ear tip according to the embodiment of the present disclosure;

FIG. 4 is a top plan view illustrating the ear tip according to the embodiment of the present disclosure;

FIG. 5 is a top plan view illustrating an ear tip according to another embodiment of the present disclosure;

FIG. 6 is a top plan view illustrating an ear tip according to still another embodiment of the present disclosure;

FIG. 7 is a vertical cross-sectional view illustrating an ear tip according to yet another embodiment of the present disclosure;

FIG. 8 is a schematic view illustrating a state in which the ear tip according to the embodiment of the present disclosure is worn in an external auditory meatus of a wearer; and FIG. 9 is a configuration view illustrating an ear tip according to still yet another embodiment of the present disclosure.

DETAILED DESCRIPTION OF THE EMBODIMENT

Hereinafter, exemplary embodiments of the present disclosure will be described in detail with reference to the drawings. Terms or words used in the present specification and the claims should not be interpreted as being limited to a general or dictionary meaning and should be interpreted as a meaning and a concept which conform to the technical spirit of the present disclosure.

Throughout the specification of the present application, when one member is disposed "on" another member, this includes not only a case where the one member is brought into contact with another member, but also a case where still another member is present between the two members. Throughout the specification of the present application, unless explicitly described to the contrary, the word "comprise" or "include" and variations, such as "comprises", "comprising", "includes" or "including", will be understood to imply the inclusion of stated constituent elements, not the exclusion of any other constituent elements.

FIG. 2 is a vertical cross-sectional view illustrating an ear tip according to an embodiment of the present disclosure, and FIG. 3 is a perspective view illustrating the ear tip according to the embodiment of the present disclosure. In addition, FIG. 4 is a top plan view illustrating the ear tip according to the embodiment of the present disclosure, and FIG. 5 is a top plan view illustrating an ear tip according to another embodiment of the present disclosure.

Referring to these drawings, an ear tip 100 according to the present embodiment is mounted on one side of an earphone and inserted into an external auditory meatus of a wearer to stably fix a position of the earphone. The ear tip 100 has a main body part 110 having a specific structure, an external auditory meatus contact part 120, a partition wall structure 130, and an elastic filling member 140. Therefore, it is possible to provide the ear tip including a partition wall structure 130 that improves an active noise canceling function and an external noise blocking force as the ear tip comes into contact with a skin surface of the external auditory meatus of the wearer when the wearer wears the ear tip in the ear.

Hereinafter, respective components constituting the ear tip 100 according to the present embodiment will be described in detail with reference to the drawings.

As illustrated in FIGS. 2 and 3, the main body part 110 of the ear tip 100 according to the present embodiment may have a hollow cylinder structure corresponding to an outer peripheral surface of an earphone.

The external auditory canal contact part 120 may have a structure radially protruding from an outer peripheral surface of a lower end of the main body part 110 and extending upward by a predetermined height and is configured to come into contact with the inner surface of the external auditory canal of the wearer.

As illustrated in FIGS. 2 and 3, the partition wall structure 130 may be mounted and structured to device a space defined by the outer peripheral surface of the main body part 110 and an inner peripheral surface of the external auditory meatus contact part 120. In this case, the partition wall structure 130 according to the present embodiment may be made of a flexible material that may be naturally deformed by a pressure of a user's finger.

In addition, the elastic filling member 140 may be a material accommodated in any space selected from the spaces divided by the partition wall structure 130 and having a predetermined magnitude of elastic restoring force. Specifically, the elastic filling member 140 according to the present embodiment may be made of an elastic material having a predetermined magnitude of elastic restoring force, for example, made of silicone gel or polyurethane gel.

In some instances, the elastic filling member 140 may have a sealed structure to isolate an internal space defined by the partition wall structure 130 from the outside. In this case, the elastic filling member 140 may be injected and accommodated in the space defined by the partition wall structure 130. In this case, the elastic filling member 140 may be a fluid having a predetermined magnitude of viscosity. The elastic filling member 140 may be injected into the sealed space and serve, together with the partition wall structure 130, as an elastic body having a predetermined magnitude of elastic restoring force.

In contrast, as illustrated in FIGS. 2 and 3, when the internal space defined by the partition wall structure 130 has a structure opened at an upper side thereof, the elastic filling member 140 may be a solid phase material having a predetermined magnitude of elastic restoring force. For example, the elastic filling member 140 may be a material made by solidifying silicone gel or polyurethane gel so that the material does not flow. In this case, the elastic filling member 140 may be attached and fixed to the internal space defined by the partition wall structure 130 by means of a cohesive material.

FIG. 6 is a top plan view illustrating an ear tip according to still another embodiment of the present disclosure, and FIG. 7 is a vertical cross-sectional view illustrating an ear tip according to yet another embodiment of the present disclosure.

Referring to these drawings compared to FIG. 3, the partition wall structure 130 of the ear tip 100 according to the present embodiment may be made of a flexible material that may be naturally deformed by a pressure of the user's finger.

In this case, as illustrated in FIG. 6, the partition wall structure 130 according to the present embodiment may include first and second partition walls 131 and 132 having specific structures.

Specifically, the first partition wall 131 has a plate-shaped structure that connects the outer peripheral surface of the main body part 110 and the inner peripheral surface of the external auditory meatus contact part 120 on a single plane. The first partition wall 131 may be provided in plural, and the plurality of first partition walls 131 may be mounted to be spaced apart from one another at a predetermined angle along the outer peripheral surface of the main body part 110.

In addition, the second partition wall 132 has a plate-shaped structure that connects the plurality of first partition walls 131 and has a curved structure spaced apart from the outer peripheral surface of the main body part 110 at a predetermined distance. The second partition wall 132 may be provided in plural, and the plurality of second partition walls 132 may be mounted to define hollow column structures together with the first partition walls 131.

In some instances, as illustrated in FIG. 7, the partition wall structure 130 according to the present embodiment may further include a third partition wall 133 configured to divide, in a vertical direction, the space defined by the outer peripheral surface of the main body part 110 and the inner peripheral surface of the external auditory meatus contact part 120.

In this case, a designer may implement various types of wearing comfort by selectively filling the plurality of spaces S defined by the partition wall structure 130 with the elastic filling member 140 in accordance with the requirement of a purchaser or user.

In addition, the space filled with the elastic filling member 140 may be specified so that the elastic filling member 140 may be naturally deformed and in close contact with the structure of the external auditory meatus of the wearer. As a result, it is possible to provide the ear tip structure capable of being customized and applied to various structures of the external auditory meatuses of the several wearers.

FIG. 8 is a schematic view illustrating a state in which the ear tip according to the embodiment of the present disclosure is worn in an external auditory meatus of a wearer, and FIG. 9 is a configuration view illustrating an ear tip according to still yet another embodiment of the present disclosure.

Referring to these drawings together with FIGS. 6 and 7, the elastic filling member 140 according to the present embodiment may be made of a material including a phase change fluid that experiences phase transition between a gel state and a solid state by external electrical stimulation.

Specifically, the above-mentioned phase change fluid is a substance that experiences the phase transition between the gel state and the solid state by the external electrical stimulation. The phase change fluid may include supercooled substances and nuclear particles for changing the phase of the supercooled substances. In this case, the nuclear particles may be graphite or conductive particles mixed with the supercooled substances to transmit the electrical stimulation to the phase change fluid.

As illustrated in FIG. 9, the ear tip 100 according to the present embodiment may include a solid phase transition stimulation unit 151, a liquid phase transition stimulation unit 152, a wearing detection unit 153, an electric power supply unit 154, and a control unit 155 that perform specific functions.

Specifically, the solid phase transition stimulation unit 151 may be mounted on one surface of the main body part 110, include a plurality of electrodes introduced into the space S defined by the partition wall structure 130, and apply electrical stimulation to the interior of the space S defined by the partition wall structure 130 by being supplied with electric power from the electric power supply unit 154.

The liquid phase transition stimulation unit 152 may be mounted on one surface of the main body part 110, include a plurality of thermoelectric elements introduced into the space S defined by the partition wall structure 130, and apply heat to the interior of the space S defined by the partition wall structure 130 by being supplied with electric power from the electric power supply unit 154.

The wearing detection unit 153 may be mounted on the outer peripheral surface of the main body part 110, detect a state in which the ear tip is in contact with the skin of the external auditory meatus of the wearer, and transmit the detected data to the control unit 155.

The electric power supply unit 154 is mounted on one surface of the main body part 110 and includes a secondary battery that is rechargeable in a wireless manner. The electric power supply unit 144 may provide the stored electric power to the solid phase transition stimulation unit 151 and the liquid phase transition stimulation unit 152 on the basis of a control signal of the control unit 155.

The control unit 155 is mounted on one surface of the main body part 110 and includes a secondary battery that is rechargeable in a wireless manner. The control unit 155 may provide the stored electric power to the solid phase transition stimulation unit 151 and the liquid phase transition stimulation unit 152 on the basis of a control signal of the control unit 145.

In some instances, as illustrated in FIG. 6, the elastic filling member 140, which is changed in phase by the solid phase transition stimulation unit 151 and the liquid phase transition stimulation unit 152, may be disposed at the particular position. In this case, as illustrated in FIG. 8, only the portion, which is in contact with the particular position of the external auditory meatus, may change to the solid phase or the liquid phase, by providing various types of wearing comfort.

In particular, a component capable of receiving the user's input signal may be added so that the solid phase transition and the liquid phase transition of the elastic filling member 140 may be differently applied for the respective positions. In this case, the user may change the disposition of the elastic filling member 140 including the phase change fluid, such that the user may change the wearing comfort in accordance with the user's convenience and preference.

As described above, according to the ear tip of the present disclosure, the partition wall structure 130 including the first partition wall 131, the second partition wall 132, and the third partition wall 133, which have the specific structures, is provided, and the space, which is optionally selected from the spaces defined by the partition wall structure 130, is filled with the phase change fluid, such that the flexibility of the sidewalls constituting the pressure dispersion part may be changed in some instances, and the wearing comfort of the ear tip may be adjusted in accordance with the user's preference. The user may bring the ear tip into close contact with the external auditory meatus and fix the ear tip by changing the flexibility of the pressure dispersion part after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

In addition, according to the ear tip according to the present embodiment, the solid phase transition stimulation unit 151, the liquid phase transition stimulation unit 152, the wearing detection unit 153, the electric power supply unit 154, and the control unit 155, which perform the specific functions, are provided, and the flexibility of the space defined by the partition wall structure 130 may be changed depending on whether the ear tip is worn, such that the wearing comfort of the ear tip may be adjusted in accordance with the user's preference. The user may bring the ear tip into close contact with the external auditory meatus and fix the ear tip by changing the flexibility of the space defined by the partition wall structure 130 after the user wears the ear tip in the user's external auditory meatus. Therefore, it is possible to provide the ear tip including a comfortable wearing structure capable of improving an active noise canceling function by bringing the ear tip into close contact with the skin surface of the external auditory meatus of the wearer.

Only the specific exemplary embodiments have been disclosed in the above-mentioned detailed description of the present disclosure. However, it should be understood that the present disclosure is not limited to the specific forms mentioned in the detailed description, but rather, it should be understood that the present disclosure includes all modifications, equivalents, and substitutes within the spirit and scope of the present disclosure defined by the appended claims.

That is, the present disclosure is not limited to the specific exemplary embodiments and descriptions, various modifications can be made by any person skilled in the art to which the present disclosure pertains without departing from the subject matter of the present disclosure as claimed in the claims, and the modifications are within the scope defined by the claims.

What is claimed is:

1. An ear tip, which is mounted at one side of an earphone, inserted into an external auditory meatus of a wearer, and configured to stably fix a position of the earphone, the ear tip comprising:

a main body part (110) having a hollow cylinder structure corresponding to an outer peripheral surface of the earphone;

an external auditory meatus contact part (120) radially protruding from an outer peripheral surface of a lower end of the main body part (110), extending upward by a predetermined height, and configured to come into contact with an inner surface of the external auditory meatus of the wearer;

a partition wall structure (130) mounted and structured to divide a space defined by the outer peripheral surface of the main body part (110) and an inner peripheral surface of the external auditory meatus contact part (120); and an elastic filling member (140) having a predetermined magnitude of elastic restoring force and accommodated in any space selected from the spaces divided by the partition wall structure (130), wherein the partition wall structure (130) is made of a flexible material naturally deformable by a pressure of a user's finger, and wherein the partition wall structure (130) comprises:

a plurality of first partition walls (131) mounted to be spaced apart from one another at a predetermined angle along the outer peripheral surface of the main body part (110) and having a plate-shaped structure that connects the outer peripheral surface of the main body part (110) and the inner peripheral surface of the external auditory meatus contact part (120) on a single plane;

a plurality of second partition walls (132) having a plate-shaped structure connecting the plurality of first partition walls (131), having a curved structure spaced apart from the outer peripheral surface of the main body part (110) at a predetermined distance, and mounted to define a hollow column structure together with the first partition walls (131); and a third partition wall (133) configured to divide, in a vertical direction, the space defined by the outer peripheral surface of the main body part (110) and the inner peripheral surface of the external auditory meatus contact part (120).

2. The ear tip of claim 1, wherein the elastic filling member (140) is made of silicone gel or polyurethane gel.

3. The ear tip of claim 1, wherein the elastic filling member (140) comprises a phase change fluid that experiences phase transition between a gel state and a solid state by external electrical stimulation, wherein the phase change fluid comprises:

supercooled substances; and nuclear particles for changing a phase of the supercooled substances, wherein the nuclear particles are graphite or conductive particles mixed with the supercooled substances to transmit the electrical stimulation to the phase change fluid, and wherein the ear tip comprises:

a solid phase transition stimulation unit (151) mounted on one surface of the main body part (110), including a plurality of electrodes introduced into the space defined by the partition wall structure (130), and configured to apply the electrical stimulation to the interior of the space defined by the partition wall structure (130) by being supplied with electric power from the electric power supply unit (154);

a liquid phase transition stimulation unit (152) mounted on one side of the main body part (110), including a plurality of thermoelectric elements introduced into the space defined by the partition wall structure (130), and configured to heat to the interior of the space defined by the partition wall structure (130) by being supplied with electric power from the electric power supply unit (154);

a wearing detection unit (153) mounted on the outer peripheral surface of the main body part (110) and configured to detect a state in which the ear tip is in contact with the skin of the external auditory meatus of the wearer and transmit detected data to a control unit (155);

an electric power supply unit (154) mounted on one surface of the main body part (110) and configured to provide electric power, which is stored in a secondary battery rechargeable in a wireless manner, to the solid phase transition stimulation unit (151) and the liquid phase transition stimulation unit (152) in accordance with a control signal of the control unit (155); and the control unit (155) mounted on one surface of the main body part (110) and configured to control operations of the solid phase transition stimulation unit (151) and the liquid phase transition stimulation unit (152) on the basis of the data detected by the wearing detection unit (153).

* * * * *